United States Patent [19]

Blackburne

[11] 4,049,269

[45] Sept. 20, 1977

[54] RACKETS

[76] Inventor: Robin Michael Blackburne, Ardsheal Cottage, Paget 6-20, Bermuda

[21] Appl. No.: 556,188

[22] Filed: Mar. 6, 1975

[30] Foreign Application Priority Data

| | | |
|---|---|---|
| Mar. 6, 1974 | United Kingdom | 10120/74 |
| May 31, 1974 | United Kingdom | 24294/74 |

[51] Int. Cl.[2] ..... A63B 51/06

[52] U.S. Cl. ..... 273/73 D

[58] Field of Search ..... 273/73 R, 73 C, 73 D, 273/73 E, 73 F, 73 G, 73 H

[56] References Cited

U.S. PATENT DOCUMENTS

| | | | |
|---|---|---|---|
| 1,502,845 | 7/1924 | Blache | 273/73 D |
| 1,937,787 | 12/1933 | Robinson | 273/73 D |
| 3,086,777 | 4/1963 | Lacoste | 273/73 H |
| 3,545,756 | 12/1970 | Nash | 273/73 D X |
| 3,642,283 | 2/1972 | Wilkens | 273/73 H X |
| 3,664,669 | 5/1972 | Latham et al. | 273/73 D |
| 3,702,701 | 11/1972 | Vaughn et al. | 273/73 H |
| 3,814,423 | 6/1974 | Shockley et al. | 273/73 C |

FOREIGN PATENT DOCUMENTS

| | | | |
|---|---|---|---|
| 546,787 | 4/1956 | Belgium | 273/73 D |
| 855,902 | 2/1940 | France | 273/73 D |
| 308,297 | 5/1933 | Italy | 273/73 D |
| 11,774 | 8/1884 | United Kingdom | 273/73 D |
| 244,566 | 12/1925 | United Kingdom | 273/73 F |
| 3,471 | 2/1902 | United Kingdom | 273/73 D |

*Primary Examiner*—Richard J. Apley
*Attorney, Agent, or Firm*—Brisebois & Kruger

[57] ABSTRACT

This invention relates to a games racket, such as a tennis or squash racket, including a handle intended to be held in the hand, and carrying a head having an open marginal frame defining a central opening across which extends tensioned stringing carried by the head frame. Instead of being located in a single plane disposed centrally of and bounded by the head frame, the stringing of a racket embodying this invention is disposed in two generally parallel planes located on opposite sides of the frame, i.e. on opposite sides of the opposite side surfaces of the frame, and separated by a distance approximating the thickness of the frame. An elongate strip of a relatively hard synthetic plastics material extends around the central opening, and in a preferred embodiment, this strip overlies the outer peripheral surface of the frame and is provided with a plurality of stringing-receiving apertures distributed around the central opening, disposed outwardly of the outer peripheral surface, and spanning the opposite side surfaces of the frame.

9 Claims, 10 Drawing Figures

7b
6e
7
6d
6b
5
4
6
2
3a
6a
6e
6c
3b
7
3
3

7
6e
6b
6d
7b
6
6c
3b
3a
6a
4
3
3
2
5
1
1

6
6
7
7a
5
4
2a
5
7
7b
7a

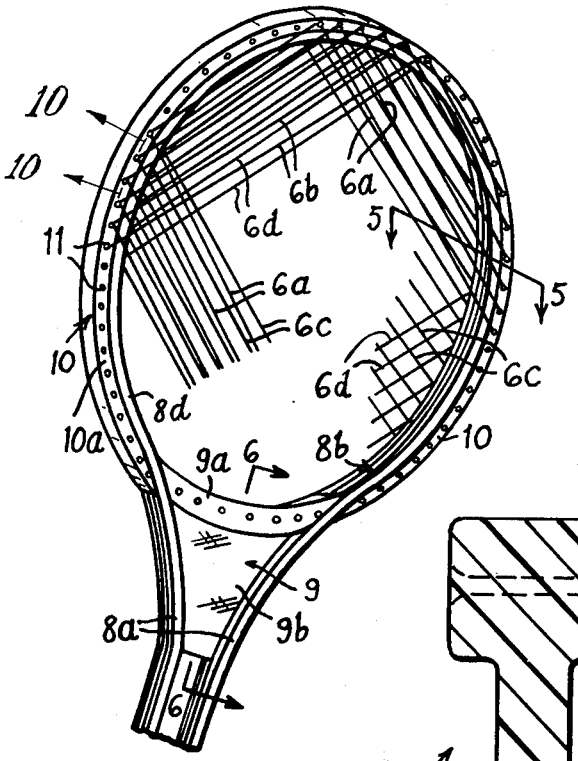
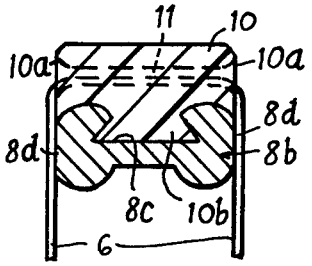
Fig. 5
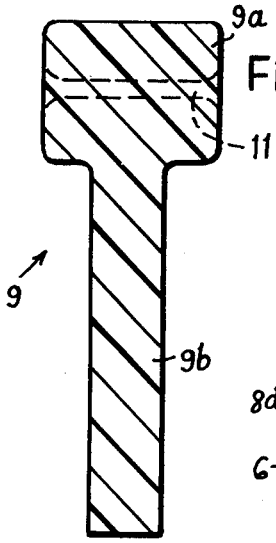
Fig.6
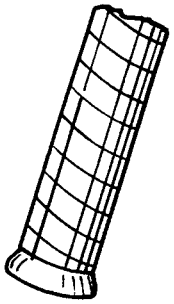
Fig.4
Fig.8
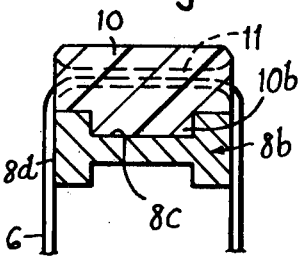
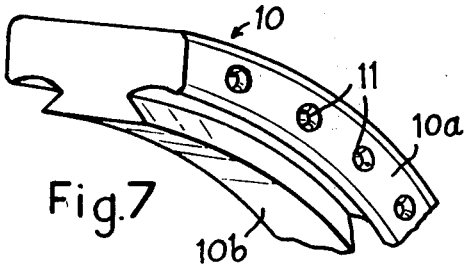
Fig.7
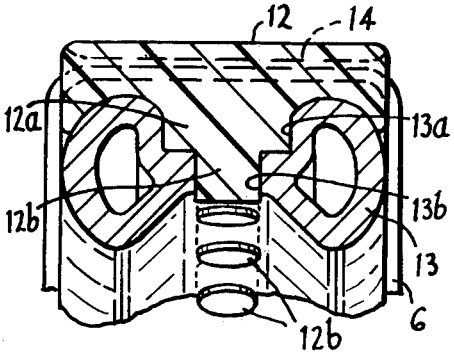
Fig.9
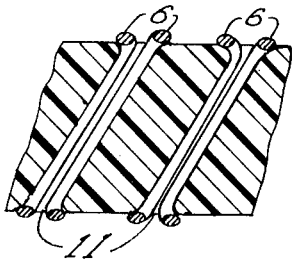
Fig.10

RACKETS

The present invention relates to rackets, such as tennis, squash or badminton rackets or the like, which are provided with tensioned stringing which forms the playing surfaces of the rackets.

Such a racket basically comprises a handle carrying a head in the form of an open marginal frame, for example a generally oval or circular frame, defining a correspondingly shaped central opening. The tensioned stringing extends back and forth across the central opening, and is composed of a first group of generally parallel string portions, and a second group of generally parallel string portions extending generally perpendicular to, and interwoven with, the string portions of the first group. The thickness of the marginal frame between the opposite side surfaces thereof, in a direction normal to the plane of the stringing, is substantially greater than that of the stringing. Such a racket will hereinafter be referred to as "a racket of the type specified".

In known rackets of the type specified, the stringing passes through peripherally distributed apertures in the frame, the apertures, at least at their ends which open through the inner peripheral or inwardly facing surface of the frame being located approximately centrally between the opposite side surfaces. Thus, the frame projects on opposite sides of the single plane containing the stringing, and therefore projects beyond both playing surfaces defined by opposite sides of the stringing by a distance approximating one half of the width of the frame in a direction normal to said plane. The amount of the projection depends upon the type and size of the racket, and, for example, in a conventional full size tennis racket, is of the order of ⅓ inch from said plane. When such a racket, which is strung centally of its frame, is used, and a player miss-hits a ball, and the ball strikes the frame or the strings adjacent the frame, i.e. plays a "wood" shot, the ball is deflected from its intended trajectory by the projecting frame, and the player usually loses the point as a result.

In order to reduce the aforementioned disadvantage of conventional centrally strung rackets, it has been proposed to provide a racket of the type specified, wherein the head carries tensioned stringing which is disposed in two generally parallel planes separated by a distance approximating the thickness of the frame.

Thus, instead of the stringing, and therefore the playing surfaces defined thereby, being recessed with respect to the surrounding frame, the playing surfaces are generally flush with the frame on opposite sides thereof. Sinch the projection of the frame relative to the playing surfaces is substantially reduced, the unintentional deflection of the ball, which occurs when the equivalent of a "wood" shot is played, i.e. when the ball strikes one or other playing surface directly adjacent or in line with the frame, is reduced, and ball control maintained.

It is an object of this invention to provide an improved racket of this "double-strung type."

According to the present invention there is provided a games racket comprising a handle intended to be held in the hand, and carrying a head having an open marginal frame defining a central opening, across which extends tensioned stringing carried by the head, the stringing being composed of a first group of generally parallel string portions, and a second group of generally parallel string portions extending generally perpendicular to, and interwoven with, the string portions of the first group, the thickness of the frame in a direction generally normal to the plane of the stringing being substantially greater than the thickness of the stringing, and the tensioned stringing carried by the head being disposed in two generally parallel planes separated by a distance approximating the thickness of the frame, the frame including opposite side surfaces spaced apart in said generally normal direction, and the racket further comprising at least one substantially incompressible, elongate, strip-like member extending around the central opening and carried by the frame, said at least one strip-like member being formed therein with a plurality of apertures distributed along its length and around substantially the entire central opening, the apertures extending in a direction between the planes of said side surfaces, and the stringing passing through the apertures.

In order that the invention may be more readily understood, various embodiments thereof will now be described with reference to the accompanying drawings, in which:

FIG. 4 is a perspective view of a third embodiment of racket;

FIG. 5 is a section on the line 5—5 of FIG. 4, on an enlarged scale;

FIG. 6 is a section through the throat piece, on the line 6—6 of FIG. 4;

FIG. 7 is a fragmentary perspective view of the overlying strip shown in FIG. 4;

FIG. 8 is a section, similar to that of FIG. 5, of a modified head construction;

FIG. 9 is a section, similar to that of FIGS. 5 and 8, showing the application of an overlying strip embodying the invention to the existing metal frame of a conventionally centrally strung racket, to convert the racket to double stringing; and FIG. 10 is an enlarged view in section taken along line 10—10 of FIG. 4, and showing a modification in which the string-receiving apertures are inclined.

Figures 1, 2, 3:
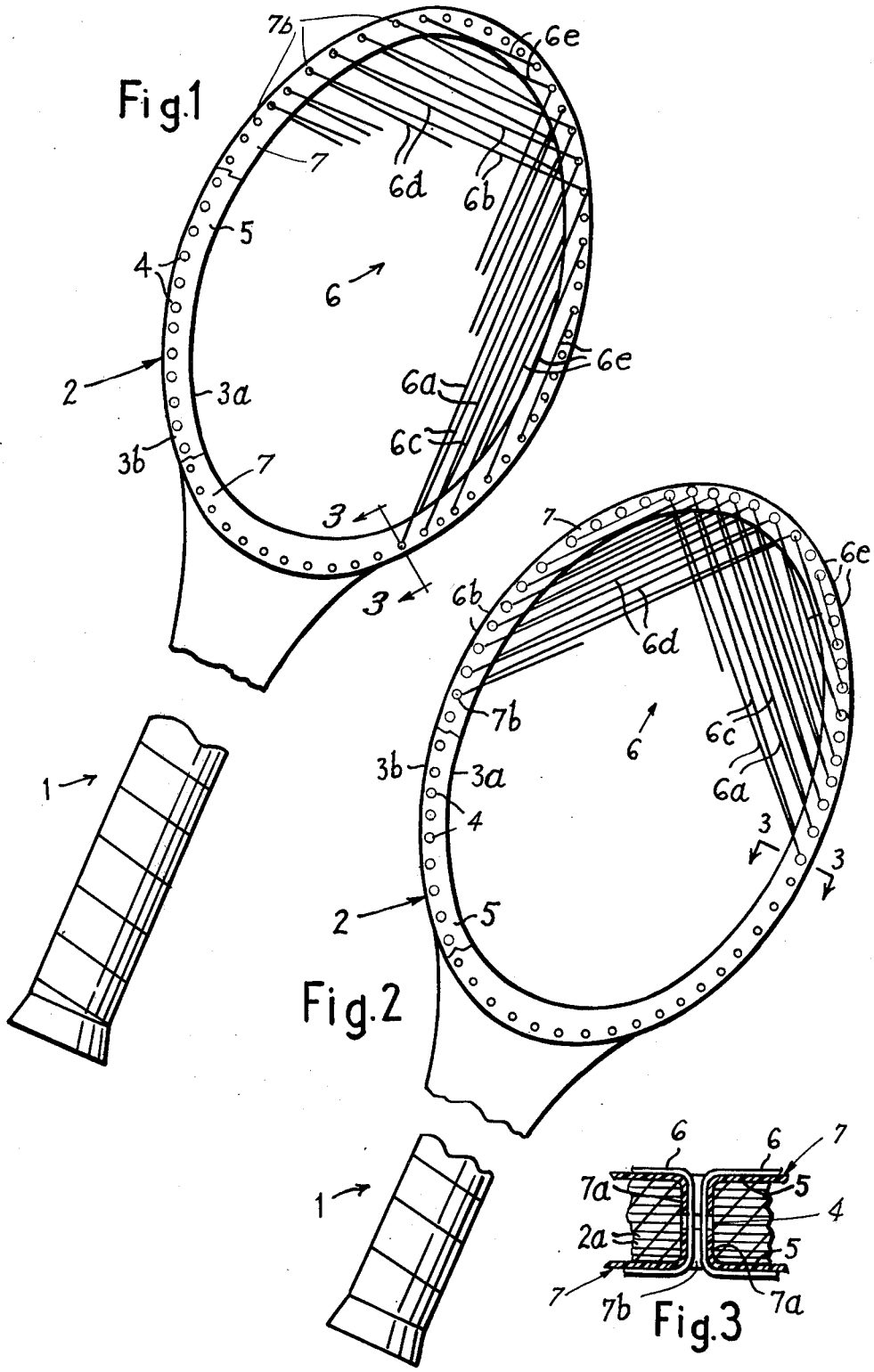
FIGS. 1 and 2 are plan views of two different embodiments of racket, with parts of the stringing, and of the overlying stripe omitted for clarity.
FIG. 3 is a fragmentary section on the line 3—3 of FIG. 1 or 2, on an enlarged scale.

FIGS. 1 and 2 both show a racket, such as a tennis racket, including a handle 1 and a head having a frame 2, made from any suitable material. For example, the frame and/or the handle may be made from laminated wood, metal, synthetic plastics material, glass fibre, or any other suitable materials, or combinations thereof.

Instead of boring stringing-receiving apertures through the frame 2 in a generally radial direction between the inner and outer peripheral surfaces **3*a* and 3*b* of the frame, as in the case of a conventional, centrally strung racket, in these embodiment apertures 4, which are distributed completely around the frame, are bored or otherwide formed through the frame 2 in a direction such that their longitudinal axes extend generally normal to the plane of FIGS. 1 or 2, between and opening into the opposite side surfaces of the frame, one of which side surfaces is indicated at 5**.

Overlying each side surface and extending around the frame 2 is a strip 7 which is curved, or capable of being flexed, to correspond to the curvature of the frame as viewed in FIGS. 1 or 2, and which may define a closed or continuous loop. Formed integrally with, and projecting from, each strip 7, is a plurality of tubular bodies 7*a* as shown in FIG. 3, the individual tubular bodies 7*a* being aligned with respective ones of the apertures 4 in the frame 2. The bodies 7*a* associated with the two strips 7 are pressed fitted into opposite ends of the apertures 4, and form sleeves or grommets which line these apertures 4. The apertures or passages 7*b* in the body 7*a* open through the faces of their associated strips 7 as shown in FIGS. 1 and 2.

The cross-section, for example diameter, of the passages or apertures 7*b* is greater than that of the single or compound filament, i.e. natural gut or synthetic fibre, of which the tensioned stringing 6 is composed. The apertures 7*b* are bevelled at their outer ends so as to blend smoothly into the outer surfaces of their associated strips 7 and thus minimize chafing of the stringing. The strips 7 and their associated tubular bodies are formed from a hard plastic material, such as toughened Nylon or ABS (acetyl butadiene styrene).

The strips 7, including their tubular bodies 7*a*, serve to protect the stringing 6 from chafing against the relatively hard material of the frame 2. In particular, the tubular bodies 7*a* prevent chafing within the apertures 4, whilst the strips 7, which space the stringing away from the side surfaces 5 of the frame, for example by $\frac{3}{8}$ inch, prevent chafing against the side surfaces.

The stringing filament is passed through the stringing-receiving passages or apertures 7*b* in the frame 2, back and forth across the opening surrounded by the frame, so as to produce two interconnected sets of appropriately tensioned string portions, one set 6*a*, 6*b* lying in the plane which is generally flush with the plane of that side surface 5 of the frame which is uppermost in FIG. 1, and the other set 6*c*, 6*d* lying in a plane parallel to the plane of the first set 6*a*, 6*b* and generally flush with the plane of the opposite side surface of the frame which is lowermost and concealed in FIG. 1. Each set comprises two groups of substantially parallel string portions, the string portions of one group 6*a* or 6*c* being generally perpendicular to, and interwoven with, the string portions 6*b* or 6*d* respectively of the other group. The distribution or mutual spacing of the apertures 4 and 7*b* around the frame 2 are such that the mutual spacing and orientation of the string portions in both groups in each set are the same as, or similar to, those of the string portions of a conventional centrally strung racket, although this is not essential. However, additional string portions may be provided, such as those indicated at 6*e* disposed closely adjacent to, and overlying, the frame 2, which portions would not be present in a conventionally strung racket.

Although the ends of the stringing may be anchored by knots which cooperate with the outer ends of one or more of the apertures 7*b*, since those knots may project from the planes of the side surfaces, they could be engaged by, and adversely deflect, a ball striking the frame. For this reason the stringing preferably commences and terminates in knob located at the peripherally outer ends of additional and radially extending apertures (not shown), i.e. apertures extending between the peripherally inner and outer surfaces 3*a* and 3*b* of the frame.

Due to the length of the stringing filament required, the stringing is produced from two or more seperate filaments. For example one filament may be enployed to produce the string portions 6*a* and 6*c*, whilst another filament may be employed to produce the portions 6*b* and 6*d*.

In the embodiment of FIG. 1, the longitudinal axes of the apertures 4, and of the apertures 7*b* are parallel, and perpendicular to the plane of the Figure, i.e. to the parallel planes of the sets of stringing portions, so that the string portions 6*a* and 6*b* of one set diverge relative to the string portions 6*c* and 6*d* respectively of the other set as viewed in FIG. 1. Alternatively, the axes of the apertures could be inclined relative to said planes, so that the string portions of one set are parallel to and aligned with, or alternatively parallel to and offset with respect to, the string portions of the second set, as viewed in FIG. 1.

The side surfaces of the frame and of the stripe 7 flat, as the stringing 6 lies on the side surfaces of the strips, although the side surfaces could be recessed to accommodate the stringing if required. The apertures 4 are preferably located as near to the outer peripheral surface 3*b* of the frame 2 as possible, for example approximately $\frac{1}{8}$ inch or less from the surface 3*b*. Since the frame 2 carries tensioned stringing on both sides thereof, it is subject to approximately twice the loading which is imparted to a conventional, centrally strung racket head due to the tension in its string portions, and the frame in FIG. 1 will be dimensioned, or strengthened, to resist this additional loading. For this reason, the frame may be increased in thickness between its inner and outer peripheral surfaces 3*a* and 3*b* relative to a conventional racket frame, in which case, the apertures 4 may be spced from the inner peripheral surface 3*a* by a distance approximating the thickness of a conventional frame.

In the embodiment of FIG. 1, the string portions of the groups 6*a* and 6*c* extend generally parallel to the longitudinal axis of the racket, i.e. the longitudinal axis of the handle 1, and the string portions of the groups 6*b* and 6*d* extend generally perpendicular to this axis.

The racket shown in FIG. 2 differs from that shown in FIG. 1 in that it is strung so that the string portions of all the groups 6*a* to 6*d* extend diagonally with respect to the longitudinal axis of the racket.

The assembly of the strips 7 to the frame 2 is effected by superimposing one strip on each side surface 5, with the integral tubular bodies 7*a* approximately aligned with their associated bevelled apertures 4, where-after the tubular bodies may be readily pressed into their apertures, either successively or simultaneously, until the strips, which may be coextensive with the side surfaces, lie on the latter. Since the tubular inserts 7*a* are integral with their associated strips 7, the tedious and time consuming opertions which would be necessary to assembly individual grommets or inserts to the individual apertures 4 are eliminated.

When the racket of FIGS. 1 or 2, and in particular the frame 2, is formed from laminated material, for example from wood and/or glass fibre and/or plastics and/or metal, the planes of the laminations may extend generally perpendicular to the planes of the stringing 6, as in conventional laminated racket frames. In this event, the apertures 4 should preferably be bored outwardly of, but adjacent, a relatively hard lamination, such as a glass fibre lamination, although this is not essential, and the invention is equally applicable to all-wood rackets. However, the frame may alternatively and advantageously be laminated flat, i.e. the planes of some or all the laminations 2*a* may extend generally parallel to the planes of the stringing as specifically shown in FIG. 3. This form of lamination should be superior to conventional lamination, since the apertures 4 extend generally perpendicular to the planes of the laminations, and the tension in the stringing acts in directions generally parallel to the planes of, and the major dimensions of, the laminations.

The rackets shown in FIGS. 1 and 2, and in particular the frames 2 thereof, may be formed, moulded or extruded, from a metal such as steel, or a light metal or light metal alloy such as aluminum, for example as a moulded or extruded strip which may be of hollow or solid cross-section. However, when metal frames are employed, the stringing-receiving apertures, or at least some of these apertures, are preferably formed, not in the metal structural part of the frame, but in one or more separate members carried by the structural frame part, and formed from a material which is more compatible with the stringing, i.e. less likely to damage the stringing, than the metal of the frame.

An embodiment of such a racket is shown in FIG. 4, in which a metal strip, for example an extruded aluminium strip, is bent so that the free end portions form a pair of handle portions 8*a*, and the intermediate portion forms the structural part 8*b* of the head frame 2. A throat piece 9 is secured between the handle portions 8*a* where they blend into the structural frame part 8*b*.

As will be apparent from FIG. 5, the metal strip, or at least the part 8*b* thereof, is of generally "figure-of-eight" or "dumb-bell" cross-section, and is formed in its peripherally outwardly directed surface with a peripherally extending undercut or dovetail recess 8*c*. Overlying the outer periphery of the structural frame part 8*b* is a separate member in the form of a flexible strip 10, a portion of which is shown in FIG. 7. The strip is moulded, extruded, or otherwise formed from a relatively hard synthetic plastics material, such as toughened Nylon or ABS, or other tough plastic or other material. The thickness of the strip 10 in a direction normal to the planes of the stringing 6, i.e. the spacing between the opposite side surfaces 10*a* thereof, approximates the thickness, in the same direction, of the structural frame part 8*b*, i.e. the spacing between the opposite side surfaces 8*d* thereof. The radial height of the side surfaces 10*a*, i.e. in the planes of the stringing or directions parallel thereto, approximates that of the side surfaces 8*d*, and the height of each side surface may, in one specific and non-limiting example of tennis racket, be ⅓ inch. The inner peripheral surface of the strip 10 has a profile corresponding to that of the outwardly directed surface of the frame part 8*b*, and includes a longitudinally extending dovetail projection 10*b* which interlocks with the recess 8*c* to retain the strip 10 positively anchored to the frame part 8*b*.

Stringing-receiving apertures 11, corresponding to the apertures 7*b* in the previous embodiments, are bored or moulded into the strip 10, between and opening into the side surfaces 10*a* thereof. In this embodiment, the longitudinal axes of the apertures 11 are generally parallel to each other and perpendicular to the planes of the stringing 6.

The ends of the strip 10 blend into the frame part 8*b* adjacent the handle portions 8*a*, and, with regard to FIGS. 4 and 6, the throat piece 9 is provided with an inner marginal portion 9*a* which is of the same thickness as the frame portion 8*b* and strip 10 so as to blend in with, and lie in the same planes as, the side surfaces 8*d* and 10*a*. The marginal portion 9*a* is also provided with stringing-receiving apertures 11.

The portion 9*b* of the throat piece extending away from the head may be of any desired thickness or configuration, and may be thinner than the portion 9*a*, as shown, to save weight. The throat piece may be molded or otherwise formed from metal or a toughened synthetic plastics material of sufficient strength to resist the tensional stresses of double stringing.

As shown in FIG. 4, the groups 6*a* to 6*d* of string portions extend diagonally with respect to the longitudinal axis of the racket, as in FIG. 2, although the racket could be strung as shown in FIG. 1.

The racket shown in FIG. 4 may be simply constructed by blending a length of the extruded aluminium strip to the required shape of the handle portions 8*a* and frame part 8*b*, and then assembling the extruded strip 10 thereto by introducing the dovetail projection 10*b* longitudinally into the recess 8*c* and sliding the strip 10 around the periphery of the frame part 8*b* until it is positioned as shown. This position is preferably accurately predetermined by cooperating means, such as shoulders or steps (not shown). The dovetail projection 10*b* may be introduced into the recess 8*c* at the free end of one handle portion 8*a*, or may be introduced adjacent one side of the handle where the frame part 8*b* meets the handle, which may require modification of the undercut side walls of the recess 8*c* at the zone of insertion. The throat piece 9 is permanently secured in place, for example by screws, rivets, an adhesive, or combinations thereof, or by any other suitable securing means. The strip 10 may be secured in place in a similar way, although this is not essential. The stringing-receiving apertures 11 may be bored in the strip 10 and throat piece 9 after assembly to the frame, although preferably these apertures are formed, for example, moulded in or bored, prior to assembly.

The stringing 6, tensioned for example to 55 to 60 pounds or more, is then strung as previously described with reference to FIG. 1.

The metal strip, or at least the structural frame part 8*b* thereof, and the flexible overlying strip 10, may take a variety of different forms. For example, the frame part 8*b* may be of generally H cross-section as shown in FIG. 8, instead of "dumb-bell" section as shown in FIG. 5, and the frame part 8*b* and strip 10 may be provided with parallel-sided interfitting recess 8*c* and projection 10*b*. In this case, the frame part 8*b* and strip 10 may be secured together by securing means as previously described, or may be simply retained assembled together by virtue of the tensioning in the stringing 6.

According to an important feature of the present invention, existing conventional, centrally strung rackets may be converted to double stringing, and this may be achieved without any modification of the existing conventional frame. This conversion is of particular application to metal framed rackets, for example, those designed and manufactured by the Maark Corporation of Cranbury, New Jersey, U.S.A., and FIG. 9 shows this conversion as applied to a "dumb-bell" section frame as disclosed in their British Pat. No. 1,311,925. The conversion is achieved by removing the conventional stringing and attaching a flexible strip 12, similar to the strip 10, to the outer peripheral surface of the metal structural frame part 13. This flexible strip is manufactured as an accessory or separate entity, and is profiled as shown so as to fit the contours of the existing frame part 13. In particular, the strip 12 is provided with a continuous rib 12*a* which locates in a corresponding channel 13*a* in the outer peripheral surface of the frame part 13, the rib 12*a* being formed with bosses 12*b* which engage in some or all of the conventional stringing-receiving apertures 13b in the central web of the frame part. The bosses 12b serve to locate the strip 12 relative to the frame part, and the strip may additionally be held in place by any of the securing means previously described, or merely by the stringing 6. The strip 12 is provided with stringing-receiving apertures 14 and double stringing 6 as previously described.

If, in converting conventional, centrally strung rackets as just described, the existing frame or structural frame part thereof is considered to be of insufficient strength to withstand double stringing, the overlying strip 12 or equivalent could be designed to reinforce or form a structural part of the frame. This could be achieved by forming the overlying strip from, or reinforcing it with, a reinforcing material, such as carbon or graphite fibres, or associating it with a metal strip, and positively securing the overlying strip to the frame, so that the strip becomes a lamination forming an integral part of the frame.

From the foregoing, it will be seen that all of the illustrated rackets are of a particularly advantageous design, in which two sets of string portions are provided which are, and define playing surfaces, flush or generally flush with the opposite side surfaces of the frame. Since the playing surfaces are substantially flat over their entire extent, including the regions where the stringing overlies the said side surfaces, even when a ball is hit off-centre to a degree which would give rise to a "wood" shot with a conventional, centrally strung racket, the unintentional deflection of the ball from its intended trajectory which would normally occur is substantially reduced or eliminated, and ball control with such shots is considerably improved. Thus, the effective playing area of a racket embodying the present invention is increased by at least 20 to 30%, and possibly by a much greater amount, more nearly approaching 100%, without significantly increasing the size or weight of the racket head, and without changing its shape, in comparison with the head of a corresponding conventional, centrally strung racket.

The foregoing is of significant advantage in games played on open courts, such as Lawn Tennis, Badmington or the like, and is of further advantage in games which are played within the confines of walled courts, such as "Squash", "Rackets", and "Royal Tennis" (the latter sometimes being known as "Real Tennis", or in America as "Court Tennis" or in France as "La Paume"). One of the best shots in such games, for example in Squash, is to hit the ball close to and parallel to the wall, so that the opponent has difficulty in making a clean return shot. Frequently, with a conventional Squash racket, the player attempting the return shot is obliged to hit the ball on the racket head frame because of the proximity of the ball to the wall, producing a poor and inaccurate return shot, and frequently causing the point to be lost. With a racket embodying the present invention, this disadvantage is overcome, and the shot may be played extremely close to the wall, without any significant unintentional deflection of the ball.

In ball games employing rackets, the modern player often applies a considerable amount of slice or spin to the ball. This means that, when top spin is to be applied for example, the ball is required to contact the stringing as near as is possible to the uppermost part of the frame, travel downwardly relative to and across the stringing in contact therewith, and leave the stringing near the opposite or lowermost part of the frame. During such a shot there is a real risk that the ball will touch the protruding uppermost and/or lowermost parts of the frame of a conventional, centrally strung racket, reducing ball control. This risk is eliminated by rackets embodying the present invention, since there is no protruding and therefore interfering frame to cause deflection. Moreover far greater top spin, back spin, etc. can be produced since the ball contacts one or other of the much more extensive flat playing surfaces, for example the distance of contact can be up to 8 inches for a tennis racket. The margin of error, when applying heavy top or back spin, and other forms of spin, for example spin applied during serving where the ball remains in contact with the stringing for a longer period, is measurably and significantly reduced.

The foregoing are some of the advantages which result from playing with double-strung rackets embodying the invention. These rackets do, however, also give rise to numerous constructional advantages.

In conventional, centrally strung rackets in which the stringing-receiving apertures are bored, after formation of the frame, between the inner and outer peripheral surfaces of the frame, these apertures, which are up to 80 in number, have to be bored from up to 80 different directions. In addition, the outer peripheral surface of the frame, at least in some regions thereof, must be routed or grooved between apertures, to receive the stringing and protect it from damage, for example when the frame is struck against the ground. For these reasons, hand-made conventional frames are difficult and expensive to produce, as are mass-produced frames due to the complexity and cost of the mass production machines required to simultaneously bore apertures from up to 80 different directions and to effect the routing. Furthermore even if the frame is of moulded construction, the conventionally placed apertures render it impossible, from a practical point of view, to mold the frame in one piece.

With rackets embodying the invention, for example as shown in FIGS. 1 to 3, however, the apertures are bored, punched, pressed, stamped or drilled parallel or substantially parallel to each other between the opposite side surfaces of the frame, which is a relatively simple, rapid and cheap operation, whether carried out by hand, or automatically by means of a multi-head or — spindle, aperture-forming machine. Moreover, since the stringing passes through apertures extending between the opposite side surfaces, not the peripheral surface, the risk of damage if the frame strikes the ground, is avoided without the expense of routing.

Furthermore, due to the aperture orientation, the racket frame may be readily produced as a one-piece moulding, by means of a relatively uncomplicated mould. conventional It will be apparent that approximately twice the length of stringing will be required to string a double strung racket embodying this invention, and for this reason, the cost of the stringing material will be increased. However, since two separate sets of string portions in two different planes are provided, the effective wear on each set will be less, since each set will be struck approximately half as often as the stringing of a conventinal racket. Therefore, one of greatest maintenance costs, namely the cost of the labour involved in restringing will be approximately halved.

In the all of the embodiments, the stringing is cushioned or isolated from the frame, or at least the structural part of the frame, by a plastics or other material which is more compatible with the stringing, than the material of the frame. This tends to reduce chafing or other wear of the stringing, and reduces or distributes localized stresses. This is of particular significance when the frame is made of metal, which is less compatible with the stringing than is wood.

The racket construction shown in FIGS. 4 to 8 possesses various additional advantages.

The metal strip forming the structural frame part 8*b* and handle portions 8*a* may be mass produced, i.e. extruded or moulded, in straight lengths to the required profile, and simply cut to length and bent to the required outline. The costly process of drilling or boring stringing-receiving apertures in the frame part is totally eliminated, the strength of the frame part is not impaired by the provision of any stringing receiving apertures, and the design or configuration of the frame part is not limited by, or dependent upon the need to provide, such apertures. The plastics overlying strip 10 may likewise be mass produced by extrusion or moulding to the required profile, and the stringing-receiving apertures may be formed during this production, or subsequently, either before or after assembly of the strip 10 to the frame part 8*b*. When the apertures are preformed, appropriate steps will be taken to ensure that they will be correctly and accurately positioned around the frame part after assembly of the strip 10. The throat piece 9 may likewise be mass produced by moulding or any other appropriate process, with or without the stringing receiving apertures pre-formed therein.

The overlying strip 10, irrespective of whether it is secured in place, or merely held in place by the stringing, may be readily replaced when restringing, due to wear or changes in design, whilst retaining the same basic structural frame part 8*b*.

In ball games played within the confines of a walled court, such as Squash, in which the racket frame often strikes the walls the use of a racket employing a metal frame which is exposed at its outer periphery is often forbidden, due to the substantial risk of damage, for example chipping, of the court walls, due to the racket frame striking the walls. This risk is eliminated or substantially reduced by the provision of the overlying strip 10, as is the risk of injury to a player when struck by a racket. In addition, the strip 10 cushions the metal frame part, and eliminates wear thereof, when the frame strikes the walls or floor of the court, and any resilient excessive wear or damage of the strip 10 merely necessitates the replacement of the strip, not of the whole racket.

Conventionally strung rackets, employ first and second groups of string portions which are oriented as shown in FIG. 1, i.e. are, respectively, parallel and perpendicular to the longitudinal axis of the racket handle. With such an orientation, the string portions extending parallel to the longitudinal axis tend to be slidably displaced relative to the perpendicular string portions, in one direction when, for example top spin is applied to the ball, and in the opposite direction when, for example the ball is undercut, since the ball being spun or cut produces a reactional force on the stringing which acts in the plane of the stringing, approximately perpendicular to the said axially parallel string portions. This relative sliding movement between the string portions increases wear of the stringing. With the diagonal stringing technique as illustrated in FIGS. 2 and 4, the string portions of both groups are located at approximately 45° to the longitudinal axis of the handle, and at approximately 90° to each other. Since neither of the two groups of string portions extends generally perpendicular to the direction of the force which is applied thereto upon normal application of top or back spin, and in fact both groups are inclined at approximately 45° with respect to this direction, the tendency for the string portions to work or slide back and forth relative to each other is substantially reduced.

An additional advantage of such diagonal stringing is that a more equally balanced string loading on the frame will result, particularly in the case of a racket which is more oval than round, and where the throat piece is set into the frame.

It will be understood that various modifications may be made without departing from the scope of the present invention as defined in the appended claims.

For example, the axes of the stringing-receiving apertures may be inclined relative to the planes of the playing surfaces, as shown in FIG. 10, to produce two sets of string portions which are mutually parallel, instead of divergent as shown, whilst employing the stringing technique as herein described and shown. The string portions may, in this case, be either precisely aligned when the frame is viewed in plan, i.e. in the direction of FIGS. 1 and 2, or staggered so that the string portions of one set lie half way between the string portions of the other set.

Alternatively, the aforementioned parallel stringing may be achieved without inclining the axes of the stringing-receiving apertures, by employing a different stringing technique. In this technique, the stringing filament is passed through a first aperture, across a first side surface of the frame, across the opening in the frame to the opposite or second aperture, though this second aperture from said first side surface to the second side surface, across the opening to, and through, the first aperture, from the second side surface to the first surface, along the first side surface to the next adjacent or third aperture, through the third aperture to the second side surface and across the opening to the opposite or fourth aperture adjacent the second aperture, through the fourth aperture and across the opening to, and through, the third aperture to the second side surface, and along the second side surface to and through the next adjacent or fifth aperture. This procedure is repeated to complete the stringing. It will be appreciated that this stringing technique will require at least some of the stringing-receiving apertures to be of enlarged cross-section to accommodate the additional passes of the stringing.

The foregoing parallel stringing technique produces the string portions of the two sets alternately. However, the parallel stringing could be achieved by producing the string portions of one set and then of the other set. In this technique, the stringing filament is passed through a first aperture, across a first side surface, and the opening in the frame, to and through a second opposite aperture to the second side surface, along the second side surface to the next adjacent or third aperture, through the third aperture to the first side surface and back across the opening to the opposite or fourth aperture next to the first aperture, through the fourth aperture to the second surface and along that surface and through to the next adjacent or fifth aperture. This procedure is continued to complete the string portions of one set, and is then repeated to produce the string portions of the other set.

In some games, it would in theory be advantageous to be able to play some types of strokes or shots with stringing tensioned to a particular value or range, and to play other strokes with stringing tensioned to a higher or lower value. This can be achieved by, and the feature incorporated in, a double strung racket embodying this invention, since, for example, by employing the stringing technique just described, the string portions of one set can, during stringing, be readily tensioned to a higher or lower value than that of the string portions of the other set.

As has already been mentioned, frames of double-strung rackets must be able to withstand considerably higher stresses than conventional rackets, since the forces to which the frames are subjected due to the tensioning in the two sets of string portions is approximately doubled. For this reason, apart from modifying the dimensions, cross-sectional shape or other design features of the frame, or the structural part thereof, to withstand these increased forces when the frame is formed from a material or materials conventionally employed, it is envisaged that other materials possessing increased strength may be employed, for example the frames may be formed in whole or in part from, or may be reinforced or combined with, materials such as carbon or graphite fibres, or molybdenum fibres or the like.

Although the overlying strip 10 shown in FIGS. 4, 5, 7 and 8 preferably extends continuously around the frame from opposite sides of the handle, the single strip 10 may be replaced by two or more, for example a plurality of, spaced strip or insert portions, each provided with one or more stringing-receiving apertures. The strip or strip portions may have the same side surface-to-side surface thickness as the frame, or may be thicker or thinner.

Instead or providing the metal-framed racket of FIGS. 4 to 9 with a separate overlying strip 10, or 12, the strip could be built up on, or bonded to, the frame part. Alternatively, the overlying strip could be eliminated, and apertures could be formed directly in the frame part, to receive the tubular bodies of strips such as those shown in FIGS. 1 to 3.

Alternatively, the stringing-receiving apertures may extend between and open through the inner and outer peripheral surfaces of the frame, as in a conventional, centrally strung racket. Stringing may be achieved by passing the stringing filament outwardly through a first aperture, across half the outer peripheral surface to and across one side surface of the frame, across the opening and the same side surface on the opposite side of the opening, across half the outer peripheral surface, into and through the opposite or second aperture to the inner peripheral surface, along the inner peripheral surface to the next adjacent or third aperture, into and through the third aperture to the outer peripheral surface, across the same half of the outer peripheral surface and the first side surface, across the opening and the same side surface on the opposite side of the opening, across the same half of the outer peripheral surface, and into and through the opposite or fourth aperture next adjacent to the first aperture, to the inner peripheral surface. This procedure is continued to produce the string portions of one set, and is then repeated for the string portions of the other set.

It will be appreciated that the foregoing are only some of the many alternative stringing techniques or configurations which may be employed. The stringing-receiving apertures, grooves, or equivalent stringing-accommodating means, may likewise take a variety of forms and cross-sections, and be disposed in various positions and extend in various directions.

In order to facilitate attachment of the overlying strip to the frame part **8*b* when the strip and frame are of interlocking design, for example in the embodiment of FIGS. 4 to 7, the peripherally inner surface of the dovetail projection 10*b* may be relieved or recessed by the provision of one or more longitudinally extending channels therein. This will impart additional resilience to the undercut side surfaces of the projection 10*b*, enabling the latter to be snapped into the recess 8*c*, in a peripherally inward direction, instead of by longitudinally sliding the strip 10 relative to the frame part 8*b*.**

The strips 10 or 12 of FIGS. 4 to 9 may extend along the recess **8*c* or 13*a* in the handle portions as well as in the frame part 8*b* or 13,** and in this event, the strip may extend to the free ends of the handle portions, or may terminate adjacent or under the hand grip carried by the handle portions. The strip, where it extends along the handle portions, may be reduced in height by removing all or a part of the aperture-containing part thereof, so that the strip will merely bridge the recess, and provide a subtantially smooth contour to the peripherally outer surface of the handle portions.

The stringing-receiving apertures in all of the embodiments may be bevelled to a much greater extent than as shown, at least in the regions of the ends thereof which are engaged by the stringing, and/or the apertures may be curved or inclined along at least portions of their length, so as to increase, as much as possible, the radius of curvature of the stringing, for example as viewed in FIG. 5, where it leaves the apertures.

Although the stringing-receiving apertures may, as shown in the embodiments of FIGS. 1 and 2, be located nearer to the outer peripheral surface of the frame than to the inner peripheral surface for reasons of strength. When the frame is formed from a stronger material than wood, for example steel or other metal tubing, the stringing-receiving apertures may be located centrally between the inner and outer peripheral surfaces of the frame. i.e. diametrically in the case of circular-section tubing.

With regard to the aspect of the invention exemplified in FIG. 9, it will be appreciated that the throat piece of the conventional racket to be converted will, in all probability, be unsuitable for double stringing. In this event, the packaged accessory or conversion kit as marketed will include not only the length of strip 12 or equivalent, but also a suitable double-stringing throat piece to replace the existing throat piece of the conventional racket, or an appropriate adaptor for the existing throat piece.

The throat piece referred to throughout the foregoing specification may be made from any of the materials employed for the overlying strip, such as ABS or nylon.

I claim:

1. A games racket comprising a handle intended to be held in the hand, and carrying a head having an open marginal frame defining a central opening, across which extends tensioned stringing carried by the head, the stringing being composed of a first group of generally parallel string portions, and a second group of generally parallel string portions extending generally perpendicular to, and interwoven with, the string portions of the first group, the thickness of the frame in a direction generally normal to the plane of the stringing being substantially greater than the thickness of the stringing, the frame including a structural marginal frame part defining the central opening, and a separate flexible but substantially incompressible, elongate member having an upper portion and a lower portion and formed from a relatively hard synthetic plastics material, extending substantially continuously, at least from one side of the handle, around the outer peripheral surface of said frame part to the other side of the handle, and overlying said outer peripheral surface, said frame part and said lower portion of the elongate member having at least one interfitting projection and recess, said elongate member being formed with a plurality of stringing-receiving apertures distributed around a major proportion of the peripheral extent of the frame, said apertures being spaced from the outer periphery of said upper portion of the elongate member, and extending continuously between and opening into, opposite side surfaces of said elongate member which are spaced apart in said direction, said elongate member, in the zones thereof provided with said apertures, having a thickness in said direction approximating the thickness of said frame part, and at least the outer peripheral surface of said upper portion of the elongate member, over substantially its entire length, being relatively smooth, uninterrupted, and devoid of projections, said tensioned stringing carried by the head passing through said apertures, and being disposed in two generally parallel planes separated by a distance approximating the thickness of the frame in said direction.

2. A racket as claimed in claim 1, wherein the interfitting projection and recess are of interlocking dovetail configuration, said recess being formed around said frame part in the outer peripheral surface thereof, and said at least one separate member being formed with said projection.

3. A racket as claimed in claim 1, wherein said elongate strip extends continuously around the outer peripheral surface of the frame part and at least part way along the handle, wherein the frame part is substantially devoid of stringing-receiving apertures, wherein the strip is of generally uniform cross-sectional profile throughout substantially its entire length, and wherein the stringing lies closely adjacent the opposite side surfaces of the frame.

4. A racket as claimed in claim 1, wherein the height of the opposite side surfaces of each said frame part approximate the height of the opposite side surfaces of said elongate strip.

5. A racket as claimed in claim 1, wherein said relatively hard synthetic plastics material is selected from the group consisting of toughened Nylon and acetyl butadiene styrene.

6. A racket as claimed in claim 5, wherein the axes of said stringing-receiving apertures are mutually generally parallel, and generally perpendicular to the planes of the stringing.

7. A racket as claimed in claim 1, wherein the frame is formed from an extruded aluminium strip of generally "H" or "dumb-bell" cross section, and wherein, at the juncture of the frame and handle, there is secured a separate throat piece forming a continuation of the side surfaces of the frame, the throat piece being moulded from a relatively hard plastics material.

8. A racket as claimed in claim 1, provided with a tubular steel frame, and wherein, at the juncture of the frame and handle, there is secured a separate throat piece forming a continuation of the side surfaces of the frame, the throat piece being moulded from a hard plastics material.

9. A racket as claimed in claim 1, wherein the axes of said stringing-receiving apertures are generally parallel to the axes of adjacent apertures, and wherein said axes are inclined relative to the planes of the stringing, whereby the first and second groups of string portions in one of said generally parallel planes extend in directions parallel to the directions of the string portions in the first and second groups, respectively, in the other of said generally parallel planes.

* * * * *